US006631629B1

(12) United States Patent
Fuss et al.

(10) Patent No.: US 6,631,629 B1
(45) Date of Patent: Oct. 14, 2003

(54) ANTI-THEFT PRODUCT TAG WITH BALL CLUTCH

(76) Inventors: Arthur Fuss, 4235 MaryEllen St. #301, Studio City, CA (US) 91604; Yang Xiao, 161 San Lazaro Ave., Sunnyvale, CA (US) 94086

( * ) Notice: Subject to any disclaimer, the term of this patent is extended or adjusted under 35 U.S.C. 154(b) by 0 days.

(21) Appl. No.: 10/208,158

(22) Filed: Jul. 30, 2002

Related U.S. Application Data

(60) Provisional application No. 60/308,470, filed on Jul. 30, 2001.

(51) Int. Cl.[7] ..... B65D 55/14; E05B 65/00

(52) U.S. Cl. ..... 70/57.1; 24/704.1; 24/706.4; 70/63; 70/164; 70/276; 70/386; 220/272; 220/275; 292/251.5; 292/252

(58) Field of Search ..... 70/57.1, 63, 158, 70/164, 276, 386, DIG. 34; 292/251.5, 252, 253, 315, 323, 325; 24/704.1, 704.2, 706.4; 220/215, 216, 272, 275

(56) References Cited

U.S. PATENT DOCUMENTS 1,577,678 A * 3/1926 Behrman
3,206,955 A * 9/1965 Horovitz
3,974,581 A * 8/1976 Martens et al. ..... 40/20 R
3,994,521 A * 11/1976 Van Gompel ..... 292/319
4,339,853 A * 7/1982 Lipschitz ..... 292/252 X
5,107,573 A * 4/1992 Zhang ..... 24/706.4
5,140,836 A * 8/1992 Hogan et al. ..... 70/57.1
5,359,870 A * 11/1994 Reutlinger ..... 70/456 R
5,382,061 A * 1/1995 Swift et al. ..... 292/311
5,437,172 A * 8/1995 Lamy et al. ..... 70/57.1
5,497,639 A * 3/1996 Charlot, Jr. ..... 70/57.1
5,820,176 A * 10/1998 Leon et al. ..... 292/323
6,279,358 B1 * 8/2001 Costa ..... 70/57.1

* cited by examiner

*Primary Examiner*—Lloyd A. Gall
(74) *Attorney, Agent, or Firm*—Roger A. Marrs

(57) ABSTRACT

An article surveillance includes a pair of components that are detachably connected together having a releasably grasping device engaging with an article intended to be protected. The device is coupled between the two components with a selected one of the components having an elongated prong insertably received within the other component and is held thereto by a ball clutch mechanism. The mechanism includes a tapered housing with an internal tapered wall surface enclosing a plug member having at least two balls carried in opposing grooves. The tapered housing and the plug member include a coaxial passageway for insertably receiving the elongated prong from the first component. The plug member is resiliently biased to a first position by an expansion spring causing the balls to bear against the tapered inner wall of the housing, restricting the passageway. When the prong of the first component is occupying the passageway, the sides of the prong force the balls outwardly as the plug member moves to compress the spring. The widened mouth of the housing permits the balls to expand or separate and does not place any restriction on the pin. Should the first component with the pin be withdrawn by unauthorized personnel, the plug member will be pushed into the tapered recess of the housing by expansion of the spring and the balls will contract and restrict the shaft or pin member of the first component, so as to hold the component together.

3 Claims, 3 Drawing Sheets

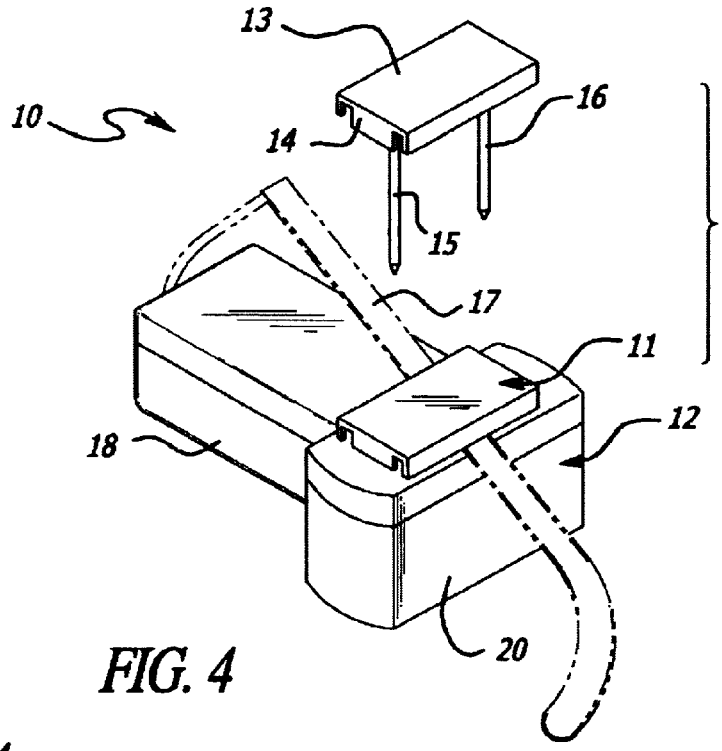
FIG. 1
FIG. 4
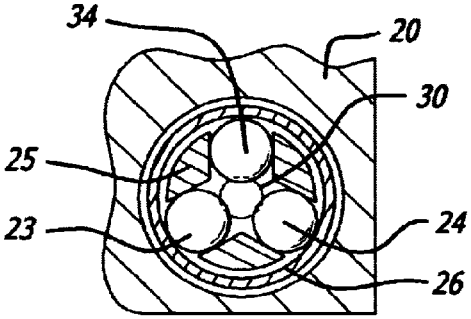
FIG. 2
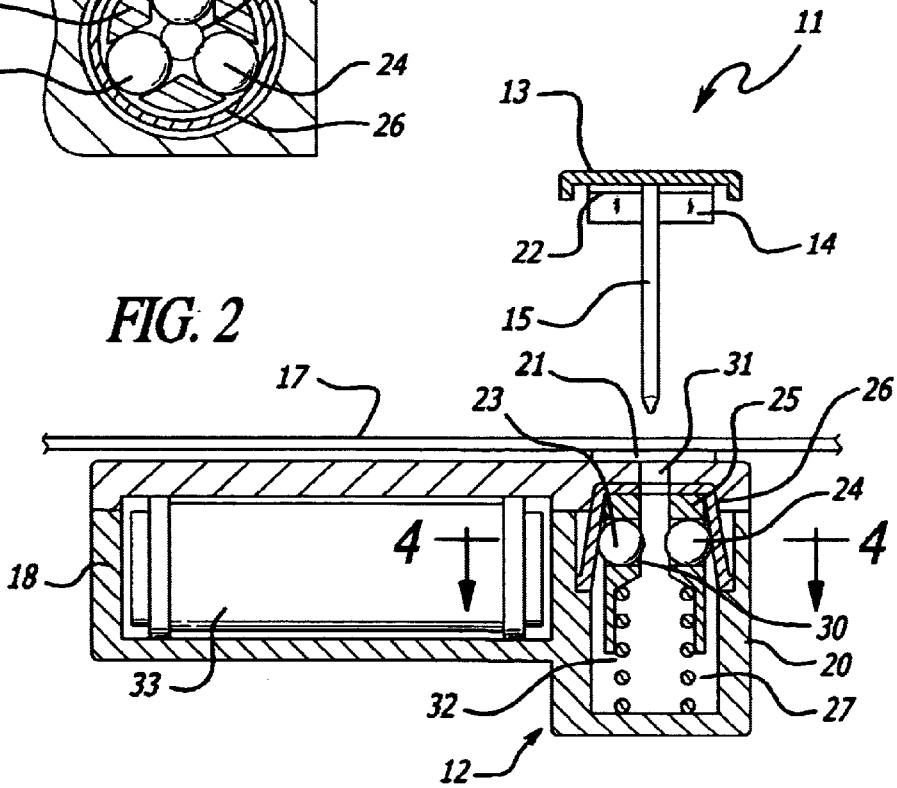

ANTI-THEFT PRODUCT TAG WITH BALL CLUTCH

Priority Based on Ser. No. 60/308,470 filed Jul. 30, 2001.

BACKGROUND OF THE INVENTION

1. Field of the Invention

The present invention relates to the field of anti-theft garment and product devices and, more particularly to a novel tag adapted to be releasably secured onto a product intended to be protected from theft, wherein such a tag includes a ball clutch for securing and releasing a pair of tag components.

2. Brief Description of the Prior Art

In the field of product loss prevention, various tags have been provided which are detachably connected to garments and which are used to activate an electronic surveillance system including an alarm which would alert attending personnel. Such previous tags usually have one component which includes a transmitter while the other component is employed as a fastening component for joining the two components to a garment. Such practice has been successful in preventing theft of garments; however, a need has existed to protect products as well such as expensive eyeglasses, beverage bottles or the like. Garment tags rely on insertion of a pin through the garment material so that the shank of the pin is attached to the transmitter component. In dealing with products such as eyeglasses and bottles, penetration of the product or article is not available so that a need has arisen to provide other means for attaching a two-component means for releasable securement onto a solid and non-penetrable product.

Therefore, a long-standing need has existed to provide a two-component product protection device which may readily attach to the solid or unpenetrable material that not only contains means for actuating an electronic article surveillance system but includes a release mechanism so that the tag or device may readily be removed from the article at the time of purchase or by authorized personnel.

SUMMARY OF THE INVENTION

Accordingly, the above problems and difficulties are avoided by the present invention which provides a novel electronic article surveillance device or tag which includes a pair of components that are detachably connected together and which includes means for releasably grasping a portion of an article engaging with the article intended to be protected. The latter means is coupled between the two components and a selected one of the components includes an elongated prong or shaft which is insertably received within the other component and is held thereto by means of a ball clutch mechanism. The mechanism includes a tapered housing with an internal tapered wall surface which encloses a plug member having at least two balls carried in opposing grooves. The tapered.housing and the plug member include a coaxial passageway for insertably receiving an elongated shaft or pin from the first component. The plug member is resiliently biased to a first position by means of an expansion spring which causes the balls to bear against the tapered interwall of the housing urging the balls to restrict the passage-way. When the shank or pin of the first.component is occupying the passageway, the sides of the pin force the balls outwardly as the plug member moves to compress the spring. The widened mouth of the housing permits the balls to expand and does not place any restriction on the pin. However, should the first component with the pin be withdrawn by unauthorized personnel, the plug member will be pushed into the tapered recess of the housing by expansion of the spring and the balls will contract and restrict the shaft or pin member of the first component, so as to hold the component together.

Therefore, it is among the primary objects of the present invention to provide a novel two-component product protection device against theft or release by unauthorized personnel which includes a ball clutch mechanism permitting a restricted retention of the two components on an article or product and yet permits release thereof by authorized personnel.

Another object of the present invention is to provide a ball clutch mechanism for releasably retaining a pair of components together about an article or product intended to be protected against theft.

Still a further object resides in providing a ball clutch mechanism for a product theft prevention tag that may be readily fastened to or unfastened from a product or product holding device which is solid and unpenetrable by a conventional prong or pin.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a front perspective view of the novel product protection tag or device illustrated in connection with attachment to the ear piece of a pair of glasses;

FIG. 2 is an enlarged longitudinal, cross-sectional view of the product protection device shown in FIG. 1;

FIG. 4 is a transverse, cross-sectional view of the ball clutch mechanism shown in FIG. 2 as taken in the direction of arrows 4—4 thereof;

DESCRIPTION OF PREFERRED EMBODIMENT

Figure 5:
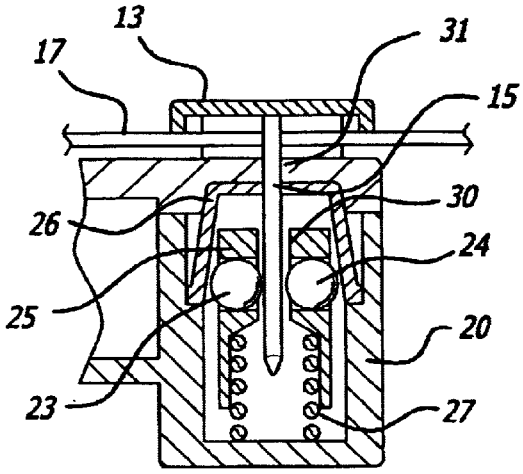
FIG. 5 is a transverse, cross-sectional view, similar to the view of FIG. 2 illustrating attachment of the two components when the clutch mechanism restricts the pin or shaft of the first component.

Referring to FIG. 1, the novel anti-theft tag or device is indicated in the general direction of arrow 10 which comprises a two-component construction wherein numeral 11 identifies one component which is detachably connected to a second component 12. The first component is illustrated in broken lines preparatory for connection with the second component 12 and the first component includes a housing 13 having downwardly depending continuous side 14 and further includes downwardly depending pins, shafts, prongs or the like. In the present instance, actuation members such as a pair of pins 15 and 16 are illustrated which are arranged in fixed, spaced apart relationship in order to provide a gap through which an item to be protected is disposed. For example, the ear pieces or arms of a pair of glasses such as indicated by numeral 17 may be placed between the pins 15 and 16 and the component 13 is then connected with the component 12 so that the product 17 is captured therebetween. It can be seen that the second component 12 which may be a transmitter unit for use in an electronic surveillance system includes an elongated portion 18 for housing a conventional transmitter. A clutch housing 20 is included in the second component 12 and is integrally formed with the transmitter housing 18. A clutch mechanism, to be described, is included in the clutch housing 20 and is employed for detachably connecting with the first component 13 by means of the pins 15 and 16 engageable with the clutch mechanism.

Referring now in detail to FIG. 2, it can be seen that the product to be protected, such as the eyeglass arm 17, is captured between a tab 21 carried on the top surface of the clutch housing 20 and a tab 22 carried on the underside of the first component 13. It can also be seen that the clutch housing 20 incorporates a ball-bearing clutch assembly which includes at least two balls 23 and 24 that are captured within recesses provided in a plug member 25. The plug member is adapted to move in a rectilinear manner within a tapered housing 26. The housing 26 includes a tapered internal recess which has a wider opening than at the bottom thereof. Therefore, the plug member may move sufficiently within the tapered recess to permit the balls to bear against the tapered wall of the housing within their respective openings. A spring 27 that may be an expansion helical spring normally urges the plug member 25 up-wardly against the top of the housing 26. Therefore, in this position, the balls 23 and 24 are forced into an elongated passageway forming a restriction and reduction in the diameter of the passageway 30. However, when the pins, such as pin 15, is inserted into the passageway 30 via an introduction passageway 31 formed in the clutch housing 20, the balls 23 and 24 are engaged and as the pins move downwardly, the movement carries the plug member against the expansion of the spring 27. This condition occurs until the backside of the balls 23 and 24 substantially reach the wider opening to the housing recess, at which time the balls expand to release the pin and permit the pin to advance further through passageway 30 residing in an internal cavity 32 in the clutch housing 20.

Removal of the first component 13 is achieved by maintaining the balls 23 and 24 at the wider opening of the housing so that the pins are not restricted and can be moved upwardly out of the clutch housing 20. It can also be seen in FIG. 2 that transmitter housing 18 includes a conventional transmitter indicated by numeral 33.

In FIG. 4, it is preferred that three balls be employed as numbered 23, 24, and 34. The use of three balls provides added surface area for engaging the respective pins. It is also to be understood that the clutch arrangement shown in FIG. 4 is on one side of the clutch housing 20 while an identical clutch arrangement is on the other side in spaced-apart relationship so as to accommodate reception of the spaced-apart pins 15 and 16.

Referring now to FIG. 5, the pins, such as pin 15, are illustrated in the restricted position, whereby the balls, such as balls 23 and 24 bear against the external surface of the respective pins. The plug member 25 has been moved through the tapered recess to compress the helical spring 27. The backside of each of the respective balls bears against the inside tapered surface of the housing 26 so that the pin will remain restricted until release. The first component 13 may be referred to as a cap with outwardly projecting pins in spaced-apart relationship while the clutch portion 20 of the second component includes not only the tab 21 but includes passageway 31 in axial alignment with the passageway 30 in the plug member.

Figure 3:
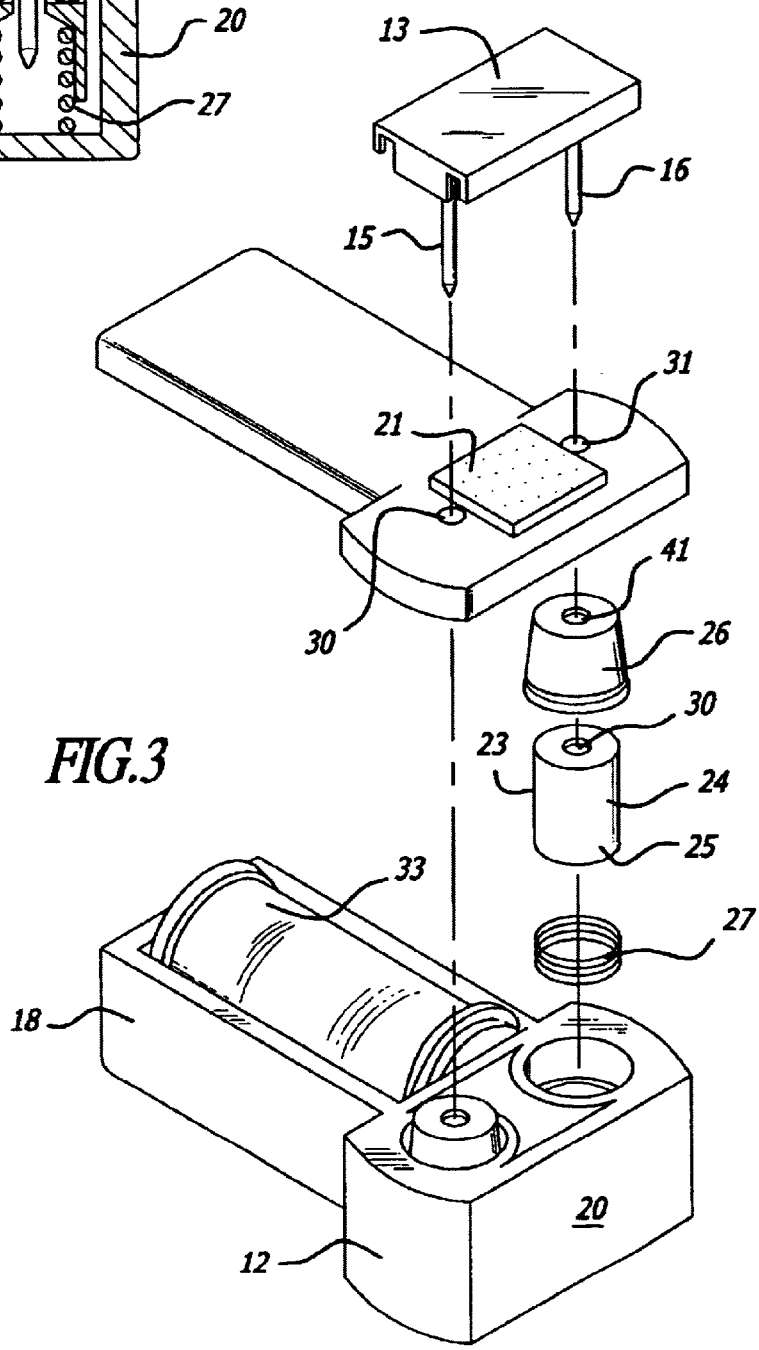
FIG. 3 is an exploded perspective view showing the various components and elements of the product protection device shown in FIGS. 1 and 2.

Referring now in detail to FIG. 3, the cap member 13 is illustrated preparatory for inserting the pins 15 and 16 into the pair of spaced-apart holes 30 and 31 in the housing 12. The housing 12 further includes the transmitter housing 18 which encloses the transmitter 33. It can also be seen in FIG. 3 that the housing 26 movably carries the plug member 25 and that the spring 27 forcibly urges the plug member 25 into the internal recess of the housing 26 so that it bears against the top of the housing. It can also be seen that the balls 23 and 24 and if three balls are used, ball 34, are outwardly projecting from the outer surface of the plug member 25. The top of the housing 26 includes an opening 31 through which the respective pin passes into the opening 30 in the top of plug 25, and thereupon, the pin engages with the ball clutch.

Figure 6:
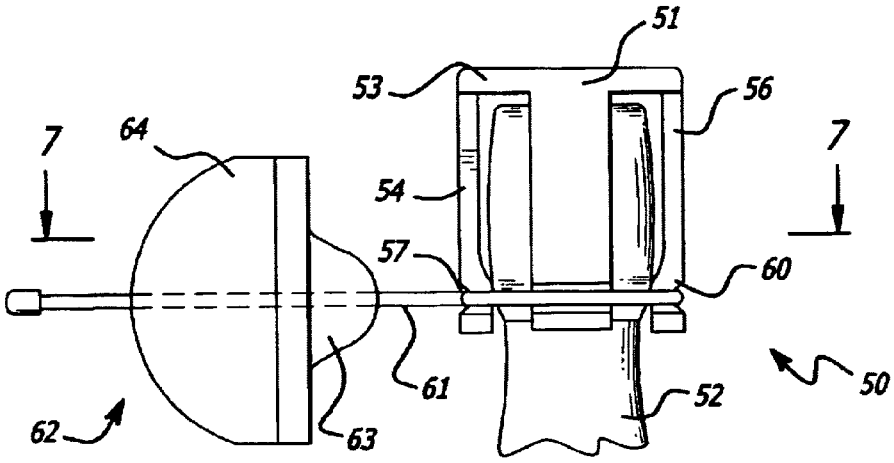
FIG. 6 is a side elevational view of another version of the present invention employed in connection with attachment of a product anti-theft device carried on the cap of a bottle.
Figure 7:
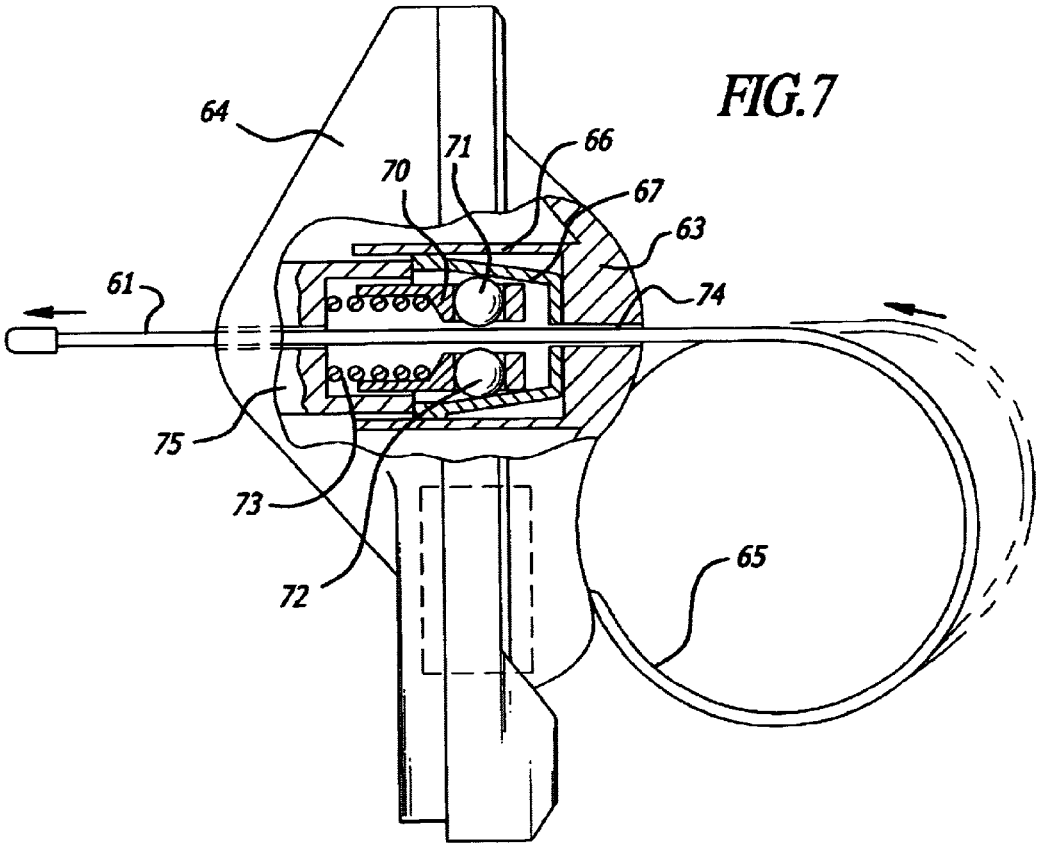
FIG. 7 is a cross sectional view of the anti-theft device version shown in FIG. 6 as taken in the direction of arrow 7—7 thereof.

Referring now in detail to FIGS. 6 and 7, another version of the invention is illustrated in the general direction of arrow 50 wherein the anti-theft device is used to restrain or secure a cap 51 onto the neck of a bottle 52. The cap 51 includes a top 53 with downwardly depending segments, preferably four, which are identified by numerals 54, 55, 56, and a similar segment on the opposite side of the device and bottle neck from the view shown in FIG. 6. The segments terminate in free ends which are formed with grooves such as indicated by numerals 57, 58 and 60. Trained about the segments within the respective grooves which are arranged in alignment, is a cord 61 that is drawn together tightly by means of the anti-theft device indicated in the direction of arrow 62. The device includes a first component 63 which may be referred to as a cap and that the cap is detachably connected to a second component which may be referred to as a body 64. It can be seen that the cord 61 passes through both components and that the cord forms a loop 65 which when tightened as shown in solid lines contracts about the segments of the cap 51 to secure the cap onto the neck 52 of the bottle. It is also to be understood that other items receiving benefit of the anti-theft feature may be encircled by the cord other than bottles.

The cap 63 includes a cylindrical sidewall 66 having an open end into which is inserted a clutch mechanism similar to the mechanism shown in FIGS. 1–5. The clutch mechanism includes a housing 67 having a internal tapered recess 68 for movably receiving a plug member 70. A plurality of balls, as previously described, are carried in openings on the plug member and a pair of the above are indicated by numeral 71 and 72. A spring 73 forcibly urges the plug member into the recess. However, upon pulling the cord 61 in the direction of the arrow, the cord is moved through a passageway 74 in the cap 63 and through coaxial openings in the housing 67, plug member 70, and a retainer body 75. Compression of the spring 73 permits the member to move away from the recess 68 and the respective balls will release the cord 61. When it is desired to restrict the cord by means of the clutch mechanism, the cord is released and spring 73 urges the plug member into the recess which causes the respective balls to bear against the narrow portion of the tapered surface to close the passageway in the plug member causing restriction of the cord.

It is to be understood that pins 15 and 16, as well as cord 61, are actuation members for operating the ball clutch mechanism and that the transmitter operates when the surveillance system is operating in order to sense the unauthorized removal of the actuation members.

In view of the foregoing, it can be seen that the anti-theft prevention device of the present invention provides a suitable means that is readily attached to either a flat article such as the arm of an eyeglass or to the neck of a bottle. A suitable transmitter may be located in the housing in either embodiment 10 or 50 and the specific transmitter employed is not a part of the present invention. The respective first and second components of either embodiment are maintained in securement or maintained released by means of the ball clutch mechanism which can be operated either by insertion of the pins in embodiment 10 or by means of the cord 61 in the embodiment 50.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. An anti-theft product tag comprising:

a housing having an internal cavity;

a ball clutch mechanism operably mounted in said cavity between a retention position and a release position;

an actuating member detachably coupled with said housing and adapted to engage said ball clutch mechanism for alternately operating said ball clutch mechanism between said retention position and said release position;

coaxial openings in said housing and said ball clutch mechanism for insertably receiving said actuating member;

an expansion spring disposed in said cavity between said housing and said ball clutch mechanism normally urging said ball clutch mechanism into said retention position, said actuating member is a cord having a first portion conducted through said housing and said ball clutch mechanism adapted to be engaged with and disengaged from said ball clutch mechanism and further having a second portion providing a loop for encircling a product intended to be retained; a body constitutes a cap having a plurality of segments with segments terminating in an end having an external groove; and said loop of said cord encircling said cap and disposed in said groove of each segment for drawing said segment ends together to provide a clamp for releasably securing said cap onto a product intended to be retained.

2. The anti-theft product tag defined in claim 1 wherein:

said ball clutch mechanism includes a set of three balls carried in grooves provided on a plug member; and a tapered wall housing having an open receptacle for movably enclosing said balls and said plug member.

3. The anti-theft product tag defined in claim 1 wherein:

said cord includes a third portion extending externally of said housing acting as a finger grasping pull portion.

* * * * *